US007234949B2

(12) United States Patent
Koyasu

(10) Patent No.: US 7,234,949 B2
(45) Date of Patent: Jun. 26, 2007

(54) MOUNTING STRUCTURE OF A CIRCUIT BOARD CONNECTOR

(75) Inventor: Ryo Koyasu, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 11/017,763

(22) Filed: Dec. 22, 2004

(65) Prior Publication Data

US 2005/0142903 A1 Jun. 30, 2005

(30) Foreign Application Priority Data

Dec. 26, 2003 (JP) ..... P2003-435842

(51) Int. Cl.
*H01R 12/00* (2006.01)

(52) U.S. Cl. ..... 439/76.1; 439/567

(58) Field of Classification Search ..... 439/76.1, 439/465, 564, 567, 676, 906
See application file for complete search history.

(56) References Cited

U.S. PATENT DOCUMENTS 4,403,819 A * 9/1983 Weber ..... 439/260
4,858,070 A * 8/1989 Buron et al. ..... 361/695
5,074,808 A * 12/1991 Beamenderfer et al. .... 439/606
5,414,597 A * 5/1995 Lindland et al. ..... 361/816
5,637,014 A * 6/1997 Sukegawa et al. ..... 439/607
5,749,754 A * 5/1998 Patterson et al. ..... 439/824
5,947,765 A * 9/1999 Carlson et al. ..... 439/535
6,012,932 A * 1/2000 Vanbesien ..... 439/101
6,034,876 A * 3/2000 Ohno et al. ..... 361/752
6,537,085 B2 * 3/2003 Na ..... 439/76.1
6,705,894 B1 * 3/2004 Comerci et al. ..... 439/607
6,887,098 B1 * 5/2005 Luo et al. ..... 439/540.1
6,896,547 B2 * 5/2005 Caveney ..... 439/535
2005/0142903 A1 * 6/2005 Koyasu ..... 439/76.1
2005/0167140 A1 * 8/2005 Caveney ..... 174/53

FOREIGN PATENT DOCUMENTS

JP 2001-307802 11/2001

* cited by examiner

*Primary Examiner*—James R. Harvey
(74) *Attorney, Agent, or Firm*—Finnegan, Henderson, Farabow, Garrett & Dunner, L.L.P.

(57) ABSTRACT

The mounting structure of the circuit board connector 1 which is conductively connected with a circuit board 3 installed in a case 2 and fixedly mounted to the case 2 comprises a connector housing 4 for joining the circuit board connector 1 with a mating connector, and a terminal 7 including first contactors 5 to be coupled with corresponding terminals of the mating connector and second contractors 6 to be conductively connected to the circuit board 3, wherein the connector housing 4 is located closer the case 2 than the circuit board between the circuit board 3 and the case 2 and fixedly tightened to screw retaining portions 8 of the case.

7 Claims, 4 Drawing Sheets

MOUNTING STRUCTURE OF A CIRCUIT BOARD CONNECTOR

BACKGROUND OF THE INVENTION

1. Field of the Invention

The present invention relates to a mounting structure of a circuit board connector, which is conductively connected to a circuit board.

2. Description of the Related Art

In general, such a circuit board connector is conductively connected to a circuit board with its housing fixedly mounted directly by screwing to and with one end of its terminal soldered to the circuit board which is then mounted together with the connector to the casing or the like of an apparatus.

While the connector housing is mounted to one side of the circuit board, electronic components are surface mounted on the opposite side of the same for security. Accordingly, when the circuit board is installed in the casing of the apparatus, the connector housing will extend outwardly from the casing thus increasing the overall dimensions.

For overcoming the above drawback, a modification of the connector is disclosed in Japanese Patent Application Laid-Open No. 2001-307802 where the connector is mounted as sandwiched between the casing of an apparatus and a circuit board which has an opening for clearing a mating connector to be connected. As the connector housing is installed in, so called a dead space where electronic components are not surface mounted on the side where electronic components are mounted, hence preventing the overall dimensions from being increased and downsizing.

However, when the connector is secured by screwing to the circuit board or coupled to a mating connector, its housing may be displaced along the bottom of the casing of the apparatus. This will exert an unwanted stress on the soldered regions where the circuit terminal is connected to the circuit board and, if worse, a conductive state can not be secured.

SUMMARY OF THE INVENTION

The present invention has been achieved with such points in mind.

It is therefore an object of the present invention to provide a mounting structure of a circuit board connector which can be avoided to create an excessive stress against a circuit board when it is mounted to the circuit board.

According to a first aspect of the present invention, for achievement of the object of the invention, a mounting structure of a circuit board connector to be conductively connected with a circuit board installed in a case and fixedly mounted to the case is provided, and comprising: a connector housing for joining the circuit board connector with a mating connector; and a terminal including first contactors to be coupled with corresponding terminals of the mating connector and second contractors to be conductively connected to the circuit board, wherein the connector housing is located closer to the case than the circuit board between the circuit board and the case and secured to screw retaining portions of the case.

The mounting structure of the circuit board connector according to the invention allows the connector housing to be secured by screws to the screw retaining portions of the case. Accordingly, any unwanted stress produced during the coupling of the connector housing to the mating connector can be received by the screw retaining portions of the case but not exerted on the second contractors of the terminal soldered to the circuit board at all, hence hardly interrupting the electrical conduction of the connector. Also, since the connector housing is located closer to the case between the circuit board and the case, the housing can hardly extend outwardly from the circuit board thus contributing to the downsizing.

According to a second aspect of the present invention, the mounting structure of a circuit board connector of the first aspect is modified wherein the connector housing has a pair of flanges which are tightened by screwing to the screw retaining portions while positional detents are provided to the two flanges and the screw retaining portion for restricting the flanges from turning at the tightening by screwing.

The mounting structure of the circuit board connector according to the present invention allows the connector housing to be prevented at its flanges by the positional detects from turning when is mounted to the case. Accordingly, when having been soldered to the circuit board, the second contactors of the terminal can hardly receive any excessive stress created during the screwing.

According to a third aspect of the present invention, the mounting structure of a circuit board connector of the second aspect is modified wherein each of the positional detects consists of a stopper projection provided on the screw retaining portion and a notch provided in the flange for engaging with the stopper projection to inhibit the displacement of the flange.

The mounting structure of the circuit board connector according to the present invention allows the connector housing to be secured by screws to the case with the notches of its flanges engaging with the corresponding stopper projections of the screw retaining portions of the case.

As set forth above, according to the first aspect of the present invention, any unwanted stress produced during the coupling of the connector housing to the mating connector can be received by the screw retaining portions of the case but not exerted on the second contractors of the terminal soldered to the circuit board at all, hence hardly interrupting the electrical conduction of the connector. Also, since the connector housing is located closer to the case between the circuit board and the case, it can hardly extend outwardly from the circuit board thus contributing to the downsizing.

According to the second aspect of the invention, the connector housing can be prevented at its flanges by the positional detects from turning with respect to the case, when tightened by screwing. Therefore, when having been soldered to the circuit board, the second contactors of the terminal can hardly receive any excessive stress that created during the screwing to the soldered area.

According to the third aspect of the invention, the connector housing is secured by screws to the case with the notches of its flanges engaging with the corresponding stopper projections of the screw retaining portions of the case. This can successfully prevent the connector housing from turning when the housing is mounted to the case.

BRIEF DESCRIPTION OF THE ACCOMPANYING DRAWINGS

DETAILED DESCRIPTION OF THE PREFERRED EMBODIMENTS

A mounting structure of a circuit board connector according to a preferred embodiment of the present invention will be described hereinafter.

A circuit board connector according to the embodiment is arranged to conductively connect with a circuit board installed in a case as being fixedly mounted to the case.

The circuit board connector having the mounting structure according to the present invention comprises a connector housing for fitting with a mating connector and a terminal which consists of first contactors to be connected to the terminals of the mating connector and second contactors to be conductively connected to the circuit board. The connector housing is anchored in a space closer to the case than the circuit board between the circuit board and the case to screw retaining portions of the case.

Figure 1:
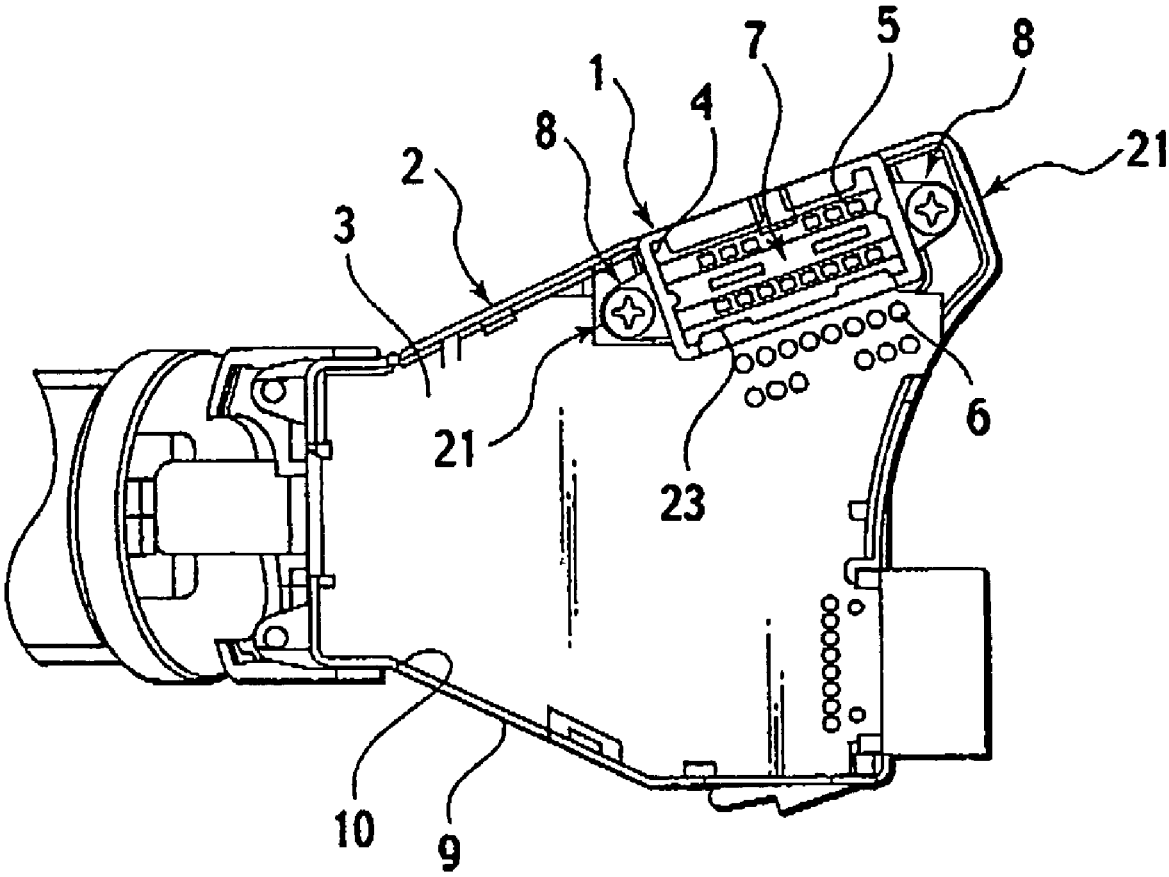
FIG. 1 is a plan view of a combination switch employing the present invention.
Figure 2A:
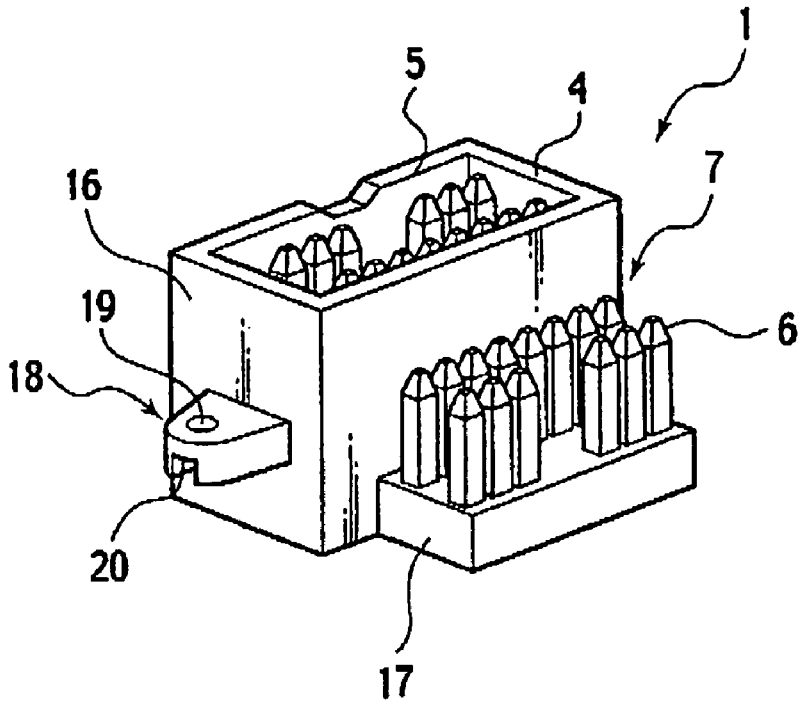
FIG. 2A is a perspective view of a circuit board connector.
Figure 2B:
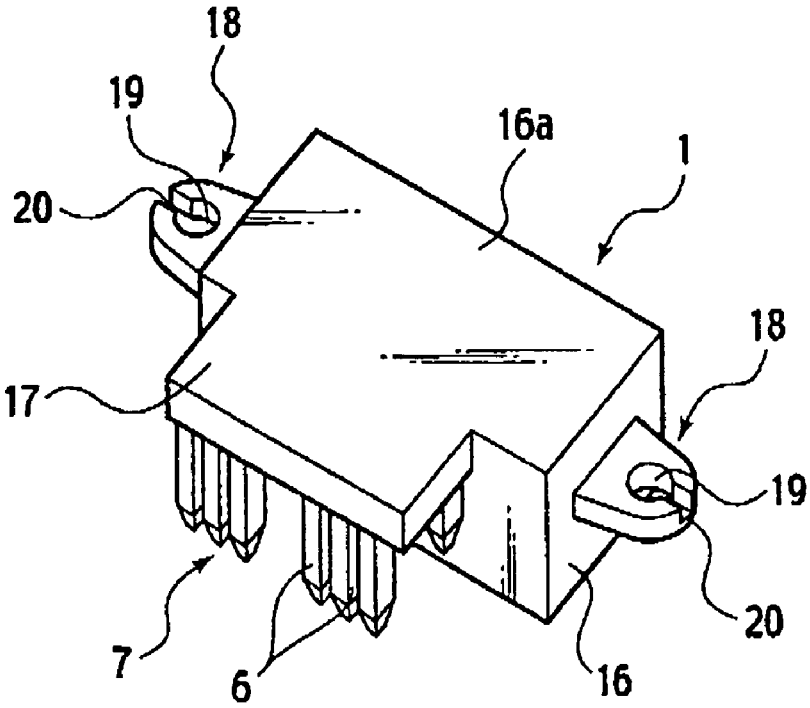
FIG. 2B is a back view of the circuit board connector shown in FIG. 2A.
Figure 3:
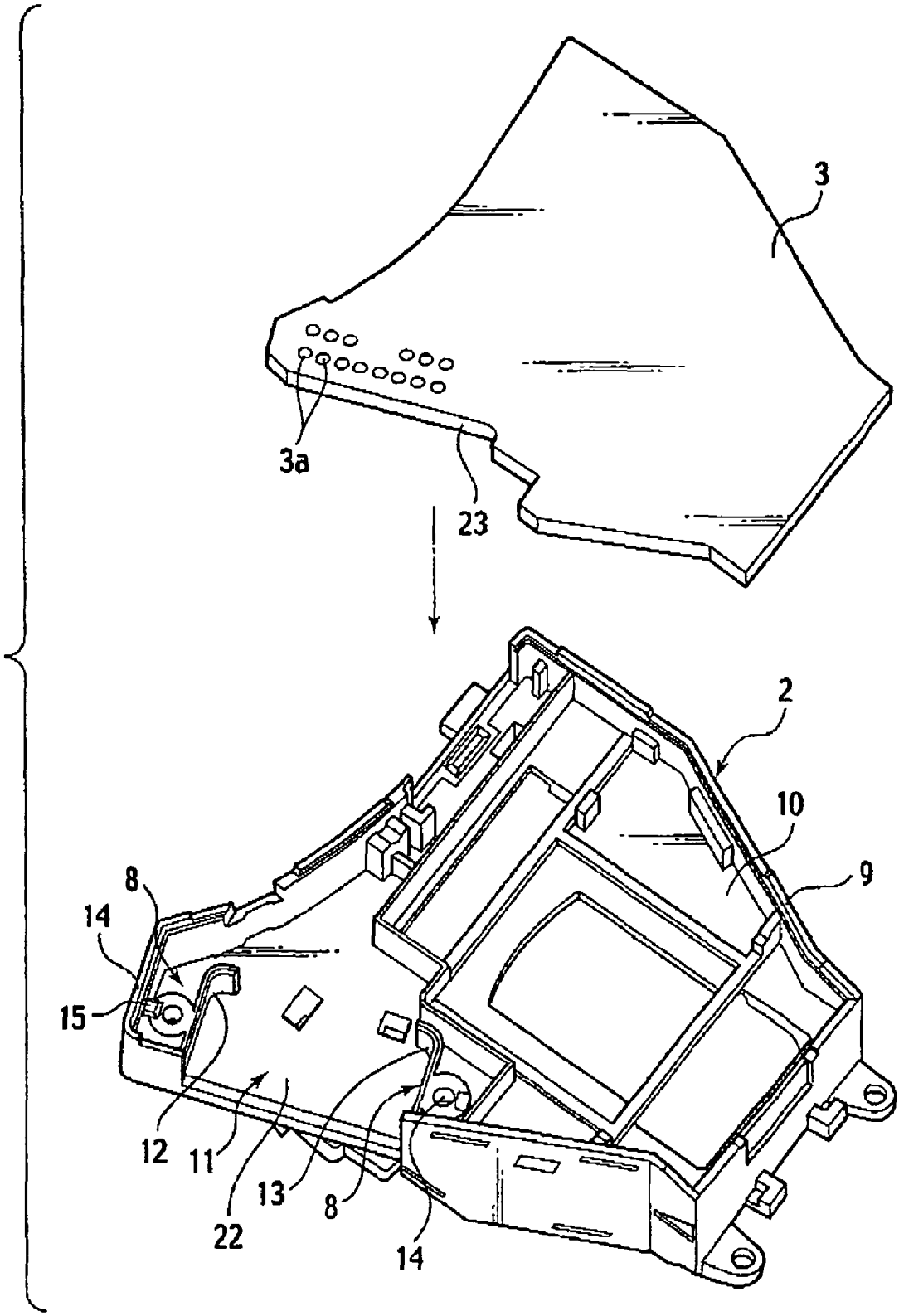
FIG. 3 is a perspective view illustrating a case to which the circuit board connector is mounted and a circuit board to be accommodated in the case.
Figure 4A:
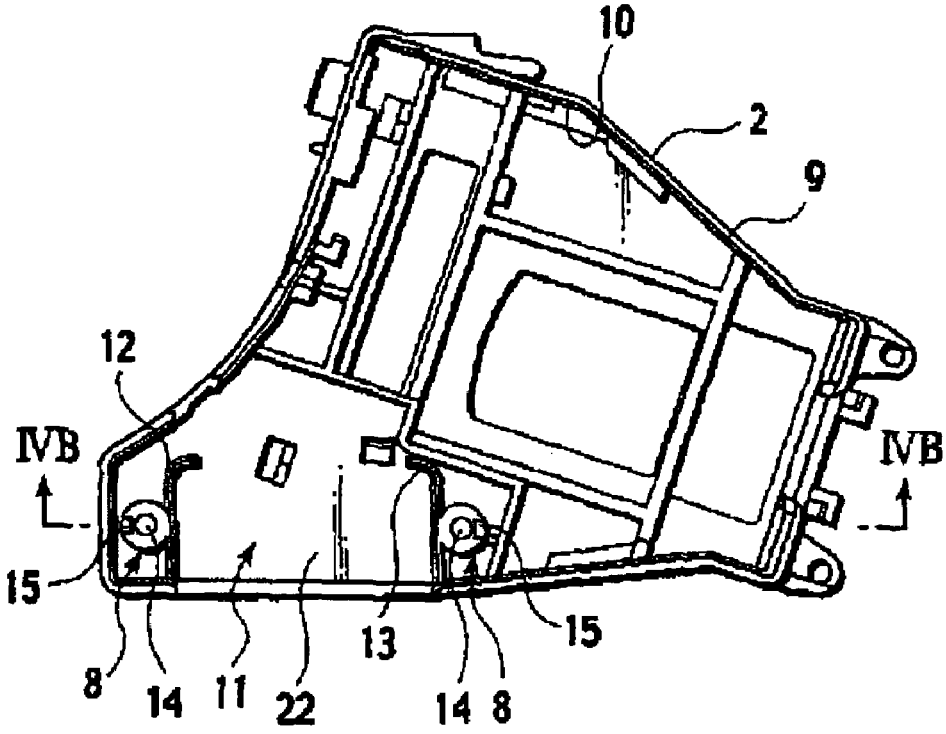
FIG. 4A is a plan view of the circuit board connector.
Figure 4B:
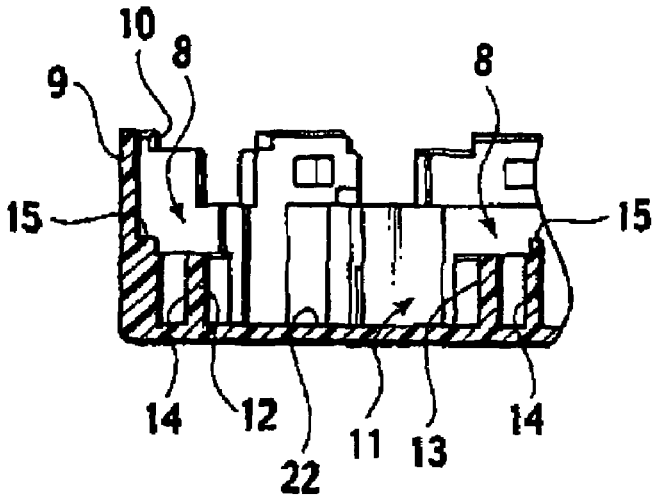
FIG. 4B is a cross sectional view taken along the line IVB-IVB of the circuit board connector shown in FIG. 4A.

The preferred embodiment will now be described in more detail with reference to attached figures. FIG. 1 is a plan view of a combination switch employing the present invention. FIGS. 2A and 2B are perspective views of the circuit board connector and FIG. 3 is a perspective view illustrating the case and the circuit board installed in the case. FIG. 4A is a plan view of the case and FIG. 4B is a cross sectional view taken along the line IVB and IVB of FIG. 4A.

The circuit board connector 1 having the mounting the structure is arranged to conductively connect with the circuit board 3 installed in the case 2 as being fixedly mounted to the case 2.

The circuit board connector 1 having the mounting structure according to the present invention comprises the connector housing 4 for fitting with a mating connector and the terminal 7 which consists of first contactors 5 to be connected to the terminals of the mating connector and second contactors 6 to be conductively connected to the circuit board 3. The connector housing 4 is anchored in a space closer to the case 2 than the circuit board 3 between the circuit board 3 and the case 2 to screw retaining portions 8 of the case 2.

The case 2 includes, as best shown in FIG. 3, a case main body 9, a circuit board accommodating space 10 provided at one side of the case main body 9 where the circuit board 3 is accommodated to cover substantially one side of the body 9, and a fitting recess 11 provided at a region of the circuit board accommodating space 10. As the connector housing 4 is installed in the fitting recess 11, the circuit board connector 1 is fixedly mounted to the case 2. More particularly, the connector housing 4 is located closer to the case 2 than the circuit board 3 between the circuit board 3 and the case 2, and anchored by screws to the screw retaining portions 8 of the case 2.

The circuit board 3 has a pattern of circuit printed on one planer side thereof and a group of electronic components surface mounted on the other side thereof as electrically connected to the circuit. A connector clearance 23 is provided at one region of the circuit board 3 corresponding to the fitting recess 11. The circuit board 3 has a group of small apertures 3*a* provided therein adjacent to the connector clearance 23. The second contactors 6 of its terminal 7 which will be explained later are fitted into the small apertures 3*a* for connection by soldering. The circuit board 3 is accommodated in the circuit accommodating space 10 of the case 2 with its electronic components mounted side facing the case 2 or its circuit printed side situated on the outer side.

The case 2 also has a couple of peripheral walls 12 and 13 provided at the fitting recess 11 thereof for positioning and holding the connector housing 4 of the circuit board connector 1. Inner side surrounded with the peripheral walls 12 and 13 is a mounting surface 22. The mounting surface 22 is provided with the connection housing 4. The two screw retaining portions 8 are provided at the outer side of the peripheral walls 12 and 13 respectively. More specifically, the screw retaining portions 8 are shaped of a round column extending along the height of the peripheral walls 12 and 13 and having threaded holes 14 opened on substantially the center of the top thereof. A couple of rectangular stopper projections 15 are provided at the outer side of the threaded holes 14 respectively far from the peripheral walls 12 and 14.

The connector housing 4 comprises, as shown in FIGS. 2A and 2B, a hood portion 16 accommodating (a group of the first contactors 5 of) one end of the terminal 7 integrated with the housing 4, a connector main portion 17 arranged integral with and projecting from the hood portion 16 on which (a group of the second contactors 6 of) another end of the terminal 7 to be conductively connected to the circuit board 3 is supported, and a pair of flange portions 18 projecting from both sides of the hood portion 16.

The terminal 7 is embedded between thy first contactors 5 and the second contactors 6 in the connector main portion 17. The hood portion 16 has one opening provided at one end thereof for accepting a mating connector and at the other end a receiving bottom 16*a* thereof which is supported directly on the mounting surface 22 at the fitting recess 11 of the case 2.

Each of the flange portions 18 has a through hole 19 provided in the center thereof across which a screw is inserted and a notch 20 provided in the back side thereof for engaging with the stopper projection 15 of the screw retaining portion 8 of the case 2. A combination of the stopper projection 15 and the notch 20 incorporates a positioning detent 21.

The procedure of mounting the circuit board connector 1 to the case 2 will now be described hereinbelow.

The procedure starts with fitting of the connector 1 into the fitting recess 11 of the case 2 so that the receiving bottom 16*a* sits directly on the mounting surface 22 with the two flanges 18 received by the corresponding screw retaining portions 8. Simultaneously, the notches 20 of the two flanges 18 are engaged with the corresponding stopper projections 15. Then, two screws are inserted across the through holes 19 and screwed into the threaded holes 14 respectively. As a result, the circuit board connector 1 is securely mounted to the fitting recess 11 and fixed to the case 2. This is followed by fitting the circuit board 3 into the circuit board accommodating portion 10 of the case 2. As the second contactors 6 of the terminal 7 are accepted in the small apertures 3*a* of the circuit board 3, they are soldered to the circuit. Accordingly, the circuit board connector 1 is conductively connected with the circuit board 3.

Since the connector housing 4 in the embodiment is secured by screws to the screw retaining portion 8 of the case 2, any unwanted stress to be exerted on the connector housing 4 can be received by the screw retaining portions 8 of the case 2 when engaging with its matching connectors. This prevents the second contactors 6 soldered to the circuit board 3 from suffering from the stress, hence ensuring the electrical connection between the two.

Also, as the connector housing 4 is installed closer to the case 2 than the circuit board 3 between the case 2 and the circuit board 3, it remains not projecting outwardly from the circuit board 3 thus minimizing the overall dimensions. More particularly, while the circuit board 3 is accommodated with its electronic components mounting side facing inwardly in the case 2, the circuit board connector 1 is allocated to fill the dead space at the electronic components mounting side hence contributing to the downsizing of the case 2.

When the connector housing 4 is joined to the case 2, its flanges 18 are held by the positioning detents 21 so as not to turn in relation to the case 2. This allows the second contractors 6 to receive no excessive stresses through the screwing when having been soldered to the circuit board 3.

Moreover, the connector housing 4 is joined to the case 2 with its flanges 18 securely engaging at the notches 20 with the stopper projections 15 of the screw retaining portions 8 of the case 2. This also prevents the connector housing 4 from turning when being joined to the case 2.

Since the circuit board connector 1 is restricted by the positioning detents 21 from any pivotal displacement while being mounted by screwing to the case 2, there will hardly be created a significant gap between the connector housing 4 and the circuit board 3 thus permitting no contamination with sneaking dust.

Although the stopper projections 15 acting as the members of the positioning detents 21 are provided on the case 2 with their corresponding notches 20 formed in the circuit board connector 1, they may be provided on the circuit board connector I with the notches 20 formed in the case 2.

One embodiments of the present invention has been explained above, but the present invention is not limited thereto, and various changes are possible within the scope of the present invention.

The entire contents of Japanese Patent Application, No. P2003-435842 (filed on Dec. 26, 2003) are incorporated herein by reference.

What is claimed is:

1. A mounting structure of a circuit board connector, comprising:

the circuit board connector directly secured to a case and conductively connected with a circuit board installed in the case;

a connector housing for joining the circuit board connector with a mating connector; and a terminal including a plurality of first contactors to be coupled with corresponding terminals of the mating connector, and a plurality of second contactors to be conductively connected to the circuit board, wherein the terminal electrically connects the plurality of first contactors to the plurality of second contactors, and wherein the first and second contactors extend substantially parallel to each other.

2. The mounting structure of the circuit board connector according to claim 1, wherein the connector housing has a pair of flanges which are tightened by screwing a screw retaining portion; and positional detents are provided for the pair of flanges and the screw retaining portion for regulating the pair of flanges from turning when tightened by screwing.

3. The mounting structure of the circuit board connector according to claim 2, wherein each of the positional detents consists of a stopper projection provided on the screw retaining portion and a notch provided in the pair of flanges for engaging with the stopper projection to inhibit the turning of the pair of flanges.

4. A mounting structure of a circuit board connector, comprising:

the circuit board connector directly mounted to a case and conductively connected with a circuit board installed in the case;

a connector housing for joining the circuit board connector with a mating connector, the connector housing comprising:

a pair of flanges which are tightened by screwing a screw retaining portion; and positional detents provided on the screw retaining portion for regulating the pair of flanges from turning when tightened by screwing, wherein each of the positional detents comprises of a stopper projection provided on the screw retaining portion and a notch provided in the pair of flanges for engaging the stopper projection to inhibit the turning of the pair of flanges; and a terminal including a plurality of first contactors to be coupled with corresponding terminals of the mating connector, and a plurality of second contactors to be conductively connected to the circuit board, as well as being installed in the connector housing, wherein the circuit board comprises a component mounting side facing the case.

5. A mounting structure of a circuit board connector, comprising:

the circuit board connector directly secured to a case and conductively connected with a circuit board installed in the case;

a connector housing for joining the circuit board connector with a mating connector; and a terminal including a plurality of first contactors to be coupled with corresponding terminals of the mating connector, and a plurality of second contactors to be conductively connected to the circuit board, wherein the terminal electrically connects the first contactors to the second contactors, and wherein the first and second contactors extend in substantially the same direction.

6. The mounting structure of the circuit board connector according to claim 5, wherein the connector housing has a pair of flanges which are tightened by screwing a screw retaining portion; and positional detents are provided for the pair of flanges and the screw retaining portion for regulating the pair of flanges from turning when tightened by screwing.

7. The mounting structure of the circuit board connector according to claim 6, wherein each of the positional detents consists of a stopper projection provided on the screw retaining portion and a notch provided in the pair of flanges for engaging with the stopper projection to inhibit the turning of the pair of flanges.

* * * * *